US006840484B2

(12) United States Patent
Jeon

(10) Patent No.: US 6,840,484 B2
(45) Date of Patent: Jan. 11, 2005

(54) GAS CYLINDER

(75) Inventor: Young Sang Jeon, Choongchungnam-do (KR)

(73) Assignee: Sam Hongea Co., Ltd., Seoul (KR)

( * ) Notice: Subject to any disclaimer, the term of this patent is extended or adjusted under 35 U.S.C. 154(b) by 0 days.

(21) Appl. No.: 10/453,734

(22) Filed: Jun. 4, 2003

(65) Prior Publication Data

US 2004/0245831 A1 Dec. 9, 2004

(51) Int. Cl.[7] ..... F16M 11/00

(52) U.S. Cl. ..... 248/161; 248/631; 297/344.19; 297/463.1

(58) Field of Search ..... 248/161, 631; 897/344.19, 463.1

(56) References Cited

U.S. PATENT DOCUMENTS 6,199,952 B1 3/2001 Davis
6,481,675 B1 * 11/2002 Yoon ..... 248/161 X

* cited by examiner

*Primary Examiner*—Anthony D Barfield
(74) *Attorney, Agent, or Firm*—Richard C. Litman

(57) ABSTRACT

Disclosed is a gas cylinder including: a spindle at least having a flange washer of a cavity shape having a region D1 and a region D2 whose inner diameters are different; a piston inserted to the open inside of the spindle; a piston rod whose one end is fixed in the piston; a base tube having a mounting member on which the lower end of the spindle is mounted with the mounting member inserted to the flange washer; and a pipe holder inserted to the tapered portion in the upper part of the spindle.

18 Claims, 7 Drawing Sheets

GAS CYLINDER

BACKGROUND OF THE INVENTION

1. Field of the Invention

The present invention relates to a gas cylinder for use in a table and a chair, for adjusting a height of a table and a chair, etc., and more particularly to a gas cylinder capable of increasing the size of a primary axis (spindle) for use in the gas cylinder, specifically increasing up and down movement width (stroke) of a spindle even at a status that the whole size of the gas cylinder is the same.

2. Background of the Related Art

A gas cylinder is an apparatus for use in an impulse buffering apparatus of an automobile, a table or a chair, for making a product installed on the gas cylinder more convenient by reducing impulse applied from the outside, or by applying restoring force in one direction. The gas cylinder according to the present invention does not exclude application to different usage such as an impulse buffering apparatus, but the gas cylinder more preferably applicable to a chair, will be described as an example.

The gas cylinder is an apparatus for exerting force in one direction the length of the cylinder increases, and in case that a user does not sit on a chair, the length of the cylinder increases by force extending in one direction. Also, in case that a user sits on a chair, extending force of a cylinder is suppressed by a weight of a user and the length of the cylinder is reduced.

Construction of a chair in which a gas cylinder of a related art is adopted, is described in detail in U.S. Pat. No. 6,199,952.

In the meantime, the construction of the gas cylinder of a related art will be briefly described in the following. The gas cylinder of a related art includes: a spindle of a cylindrical shape; a base tube of a cylindrical shape, to the inside of which the spindle is inserted; a piston whose lower end is fixed on the lower side of the base tube and inserted to the inside of the spindle. As detailed description of the gas cylinder is known by a plurality of the related arts disclosed, other details will be omitted.

With such construction, the spindle is moved up and down by external force and restoring force of gas pressure, whereby operation of the gas cylinder is performed.

But, stroke range in which the gas cylinder of the related art could move up and down, depends on the whole size of the gas cylinder in up and down directions, particularly on the size of the spindle. Therefore, in case that stroke of the gas cylinder in up and down direction should be large like the cases that a body of a user is big or a table is large, the size of the gas cylinder, particularly the size of the spindle should be larger to meet the required stroke size.

Accordingly, manufacturing costs of the gas cylinder has increased, and the gas cylinder should be designed again according to a separate specification.

Also, as separate parts for use in manufacturing the gas cylinder should be newly made, much costs has been consumed.

SUMMARY OF THE INVENTION

An object of the invention is to solve at least the above problems and/or disadvantages and to provide at least the advantages described hereinafter.

Accordingly, one object of the present invention is to solve the foregoing problems by providing a gas cylinder construction capable of maximizing stroke size of the gas cylinder.

Another object of the present invention is to provide a gas cylinder capable of reducing manufacturing costs by suggesting a gas cylinder construction capable of increasing stroke size in up and down directions while maintaining the whole size of the gas cylinder.

The foregoing and other objects and advantages are realized by providing a gas cylinder including: a pipe holder having a gas opening/closing pin for intermittently controlling gas flow; a spindle having the pipe holder on its upper inside, and having a predetermined sealing means on its lower side, and at least having a flange washer of a cavity shape, formed on a lower end of the sealing means, and consisting of a region D1 whose inner diameter is large and a region D2, whose inner diameter is smaller than that of the region D1 and whose height is higher than that of the region D1, and whose upper end is fixed approximately on a center of a seat of a chair; a piston inserted into an inside of an opened cylinder of the spindle; a piston rod whose one end is fixed in the piston; and a base tube of a cylindrical shape having a mounting member on which a lower end of the spindle is mounted with the mounting member inserted to an inside of the region D1 of the flange washer, and for fixing the other end of the piston rod in its lower side, and whose inner periphery guides an outer periphery of the spindle, and whose lower side is fixed in a base of a chair.

According to another aspect of the invention, the gas cylinder includes: a pipe holder having a gas opening/closing pin for intermittently controlling gas flow; a spindle whose upper side is tapered and to the inner tapered portion of which at least part of the pipe holder is inserted, and having a predetermined sealing means on its lower side, and at least having a flange washer of a cavity shape, formed on a lower end of the sealing means, and consisting of a region D1 whose inner diameter is large and a region D2 whose inner diameter is small; a piston inserted into an inside of an opened cylinder of the spindle; a piston rod whose one end is fixed in the piston; and a base tube and a guiding tube of a cylindrical shape having a mounting member on which a lower end of the spindle is mounted with the mounting member inserted to an inside of the region D1 of the flange washer, and for fixing the other end of the piston rod in its lower side, and whose inside guides operation of the spindle, and whose lower side is fixed in a base of a chair.

According to still another aspect of the invention, the gas cylinder includes: a pipe holder having a gas opening/closing means; a spindle whose upper and lower sides are closed by the pipe holder formed on an upper side and a sealing means formed on a lower side, and at least having a flange washer of a cavity shape, formed on a lower end of the sealing means, and consisting of a region D1 whose inner diameter is large and a region D2 whose inner diameter is small; a piston inserted into an inside of an opened cylinder of the spindle; a piston rod whose one end is fixed in the piston; and a base tube of a cylindrical shape having a mounting member on which a lower end of the spindle is mounted with the mounting member inserted to an inside of the region D1 of the flange washer.

According to the present invention, stroke distance of the gas cylinder could be maximized.

Also, manufacturing costs of the gas cylinder could be reduced.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF PREFERRED EMBODIMENTS

The following detailed description will present a gas cylinder according to a preferred embodiment of the invention in reference to the accompanying drawings. The matters defined in the description such as a detailed construction are nothing but the ones provided to assist in a comprehensive understanding of the invention. Thus, it is apparent that the present invention can be carried out without those defined matters and it will be understood by those skilled in the art that various changes in form and details may be made therein without departing from the spirit and scope of the invention.

Figure 1:
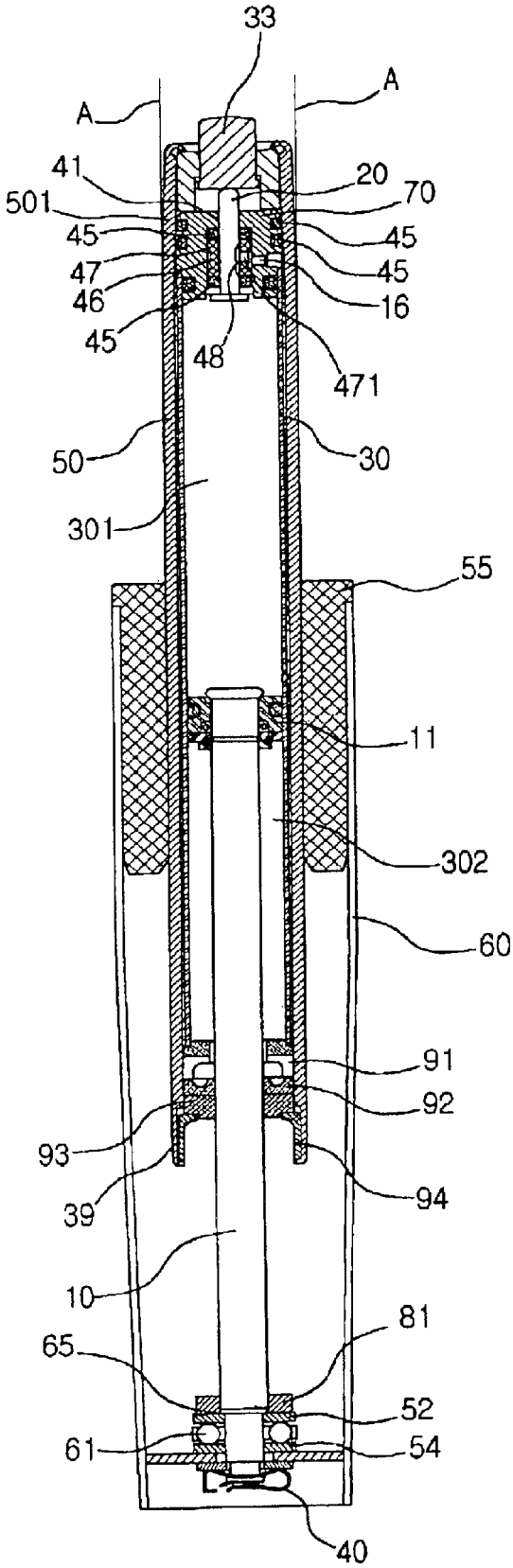
FIG. 1 is a cross-sectional view of a gas cylinder according to the present invention.

FIG. 1 is a cross-sectional view of a gas cylinder according to the present invention Referring to FIG. 1, the cylinder type gas cylinder includes: a base tube 60 of a cylindrical shape; a tube guide 55 installed in the inside of the base tube 60; a spindle 50 formed in the inside of the tube guide 55; a piston rod 10 whose one end is fixed on a lower end of the base tube 60, for moving the spindle 50 in up and down directions; and a piston 11 fixed on the other end of the piston rod 10.

Construction of the gas cylinder mentioned above, will be described in detail in the following.

The tube guide 55 is plane contacted with the outer periphery of the spindle 50, for functioning as a guiding means and a supporting means for guiding up and down movements of the spindle 50, and supporting the position of the spindle 50.

The spindle 50 includes: a cylinder 30 whose inside is filled with nitrogen gas for generating a predetermined pressure higher than an atmospheric pressure; a first and a second chambers 301 and 302 formed by compartment generated by the cylinder 30 and the piston 11; a pipe holder 70 having a gas opening/closing pin 20 fixed in its inside, for the first and the second chambers 301 and 302 to be intermittently connected each other so that gas flows.

Also, a taper part 501 which is tapered in its upper side, for being joined, in a fitting manner, to the upper side of the spindle 50, is provided. The taper part 501 could be more clearly revealed by an auxiliary line A extended from a line of the cylinder of the spindle 50. Also, generally, the lower side of the base tube 60 has a taper part for being forcibly fitted in a chair base.

The taper part 501 is tapered by a predetermined angle and is joined, in a fitting manner, to a tapered portion in the center of a chair. Also, the taper part 501 is more firmly fitted by weight repeatedly applied during usage of a chair by a user.

The piston 11 is fixed on one end of the piston rod 10, and the other end of the piston rod 10 is fixed on an end of the base tube 60 of a cylindrical shape by means of a fixing clip 40.

The pipe holder 70 is of a cylindrical shape on the whole, and has an operating hole 41 for receiving a gas opening/closing pin 20 in its center, and has a plurality of O-rings 45 fixed in an O-ring groove on its outer side, for maintaining sealing between the pipe holder 70 and the inner wall of the spindle 50. A space part 46 for gas flowing is formed in the center of the inside of the pipe holder 70, and the space part 46 also has O-rings 45 installed on its both ends, respectively, for maintaining sealing between the gas opening/closing pin 20 and the inner surface of the pipe holder 70. Also, the space part 46 has an inner holder 47 for maintenance of interval between the O-rings 45 and smooth sliding movement of the gas opening/closing pin 20. A fine hole 471 for being connected to and leading to the gas entrance port 16, is provided on one side of the inner holder. In the meantime, sealing could be sufficiently maintained by the O-ring between the pipe holder 70 and the spindle 50.

Particularly, the pipe holder 70 is inserted to the taper part 501. Due to such construction, space where gas is filled in the inside of the spindle 50 is widened and stroke where the piston 11 moves up and down gets large. In other words, at least part of the pipe holder 70 is formed in the inside of the taper part 501. Preferably, the lower end of the pipe holder 70 is positioned higher than the lower end of the taper part 501.

Also, even in case that the pipe holder 70 is inserted to the taper part 501 which is tapered in its upper side on which whole, leakage of pressure gas is possibly suppressed by an O-ring 45 formed for sealing between the pipe holder 70 and the spindle 50.

Also, a predetermined sealing means is formed on the lower end of the spindle 50, for preventing high pressure gas in the inside of the second chamber 302 from leaking out.

The sealing means includes: an open holder 91 fit in the piston rod 10 and fixed in the second chamber 302; a gas seal 92 installed in the lower part of the open holder 91, for maintaining sealing between an inner wall of the chamber 302 and the outer surface of the piston rod 10 lest gas in the inside of the second chamber 302 should leak out to the outside; a flange 93 fit in the lower part of the gas seal; and a flange washer 94. Particularly, an end of the outer skin 39 of the cylinder 30 is curled inward, whereby the flange washer 94 is fixed in order to firmly support the open holder 91, a gas seal 92, and a flange 93.

The flange washer 94 is formed with such shape, whereby up and down stroke size of the spindle 50 could increase even more.

Also, construction that the piston rod 10 is fixed in the lower side of the base tube 60 will be described in the following. Upon movement of the spindle to the down direction, a mounting member 81 with which the flange washer 94 is contacted, a bearing supporters 52, 54 and a ball bearing fit in the lower part of the mounting member 81, are provided as elements. For the mounting member 81, elastic material is preferably used so that impulse is alleviated when the spindle 50 is lowered down.

Also, the mounting member 81 is fit in the end of the piston rod 10 fixed by the fixing clip 40, for absorbing impulse applied by the spindle 50 upon up and down movements of the spindle 50. Also, the bearing supporters 52, 54 and the ball bearing 61 are not moved to the upper part of the piston rod by a movement preventing threshold 65 formed on the end of the piston rod 10, and make the spindle 50 rotate smoothly.

Procedure that the spindle 50 goes up and down along the inner surface of the tube guide 55, will be described in detail in the following.

FIG. 1 is a drawing showing a status that the gas opening/closing pin 20 is closed. As gas filled in the inside of the first chamber 301 is completely confined so that the gas may not flow through the gas entrance port 16, height of the spindle 50 is maintained at its status with respect to external force. Namely, gas flow between the first and the second chambers 310 and 302 is completely blocked, so that gas could not flow.

Figure 2:
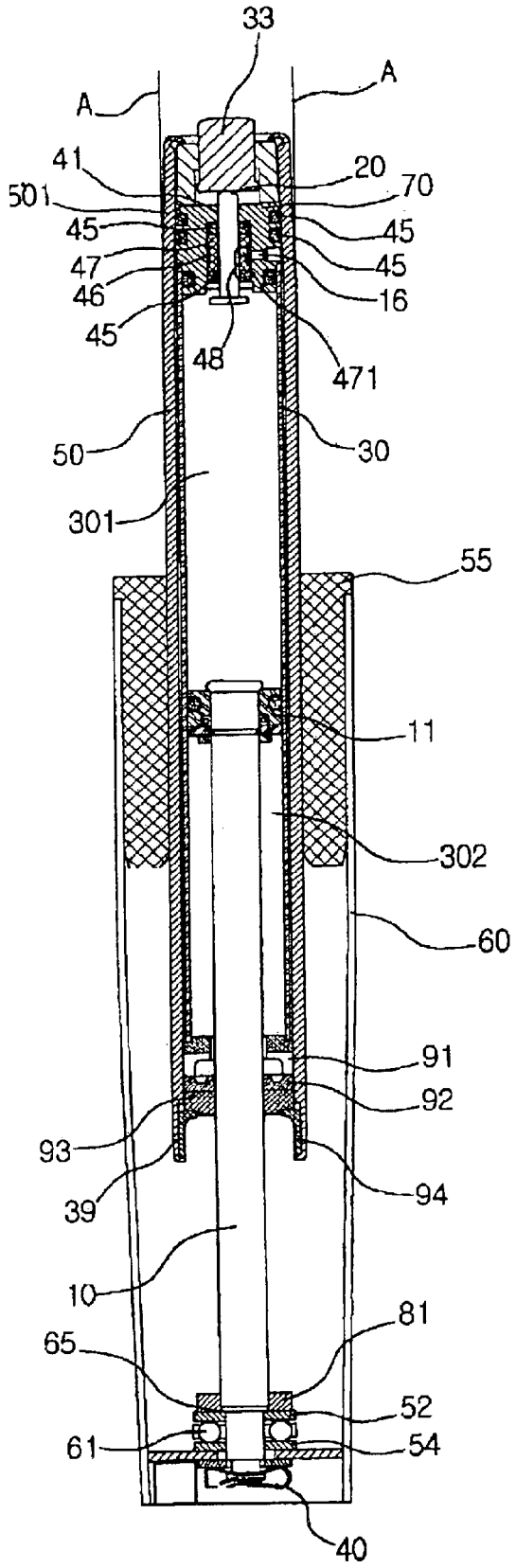
FIG. 2 is a view showing a status that a gas opening/closing pin is opened in a gas cylinder according to the present invention.

FIG. 2 is a drawing showing a status that the gas opening/closing pin 20 is open in case of adjusting height by moving the spindle 50.

Referring to FIG. 1 and FIG. 2, gas flowing will be described in the following.

If the gas opening/closing pin 20 is pressed by a button 33, the gas opening/closing pin 20 is moved to the lower side, so that sealing between the gas opening/closing pin 20 and the O-ring 45 is released by means of a concave groove 48 and a predetermined space is formed. Namely, by button pressing, the concave groove 48 formed on the center of the gas opening/closing pin 20 is moved to the lower side. At the moment, a diameter of the gas opening/closing pin 20 on the concave groove portion is smaller than that of the gas opening/closing pin 20 on other portions, so that a predetermined space for gas flowing is formed between the O-ring 45 in the inside of the pipe holder 70 and the gas opening/closing pin 20.

Also, force is applied downward on the spindle 50 by a weight of a user, and the gas in the first chamber 301 is transferred to the second chamber 302 through the opened gas entrance port 16 by applied force. If a weight of a user is not applied, the gas in the second chamber 302 is transferred to the first chamber 301 by pressure difference in the inside of the spindle 50.

If external force applied to the button 33 is removed after adjustment of height of the spindle is made, the gas opening/closing pin 20 is restored to the original position as shown in FIG. 1 by the gas pressure, blocking the gas entrance port 16 again.

Movement length of the spindle 50 to up and down directions in the gas cylinder according to the present invention will be described in detail in the following.

Figure 3:
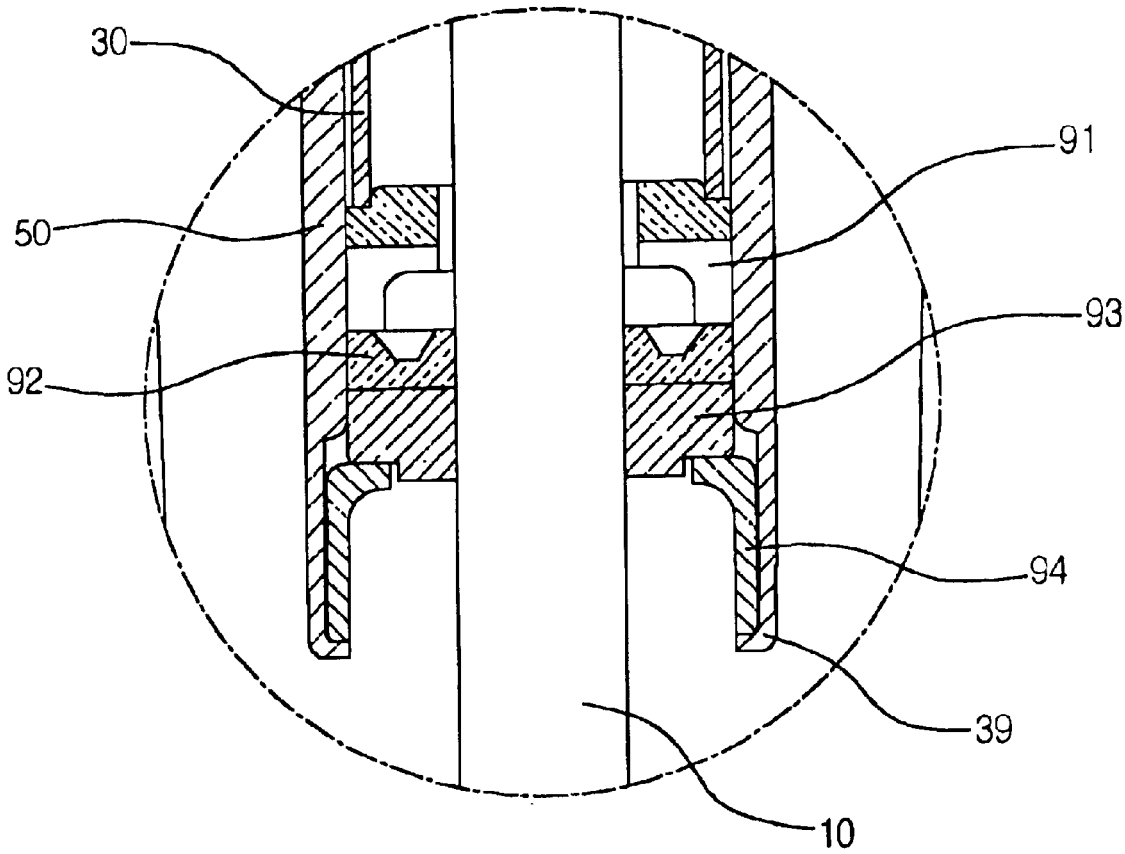
FIG. 3 is an enlarged view of a lower part of a spindle in a gas cylinder according to the present invention.

FIG. 3 is an enlarged view of the lower part of the spindle in the gas cylinder according to the present invention.

Referring to FIG. 3, the sealing means formed in the lower part of the spindle includes: an open holder 91 fit in a piston rod 10 and fixed in the lower end of the second chamber 302; a gas seal 92 installed in the lower part of the open holder 91, for maintaining sealing between an inner wall of the chamber and the outer surface of the piston rod 10 lest gas in the inside of the chamber should leak out to the outside; a flange 93 fit in the lower part of the gas seal; and a flange washer 94 formed in the lower side of the flange 93.

Particularly, an end of the outer skin 39 of the spindle is curled inward, whereby the flange washer 94 is fixed in order to firmly support the open holder 91, the gas seal 92, and the flange 93.

Figure 4:
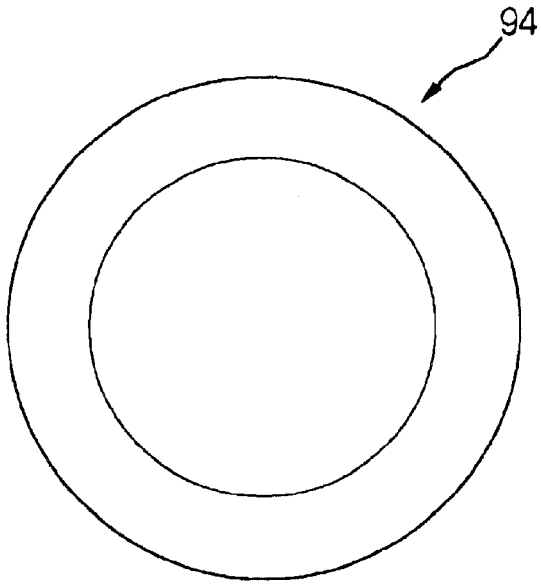
FIG. 4 is a plan view of a flange washer in the present invention.
Figure 5:
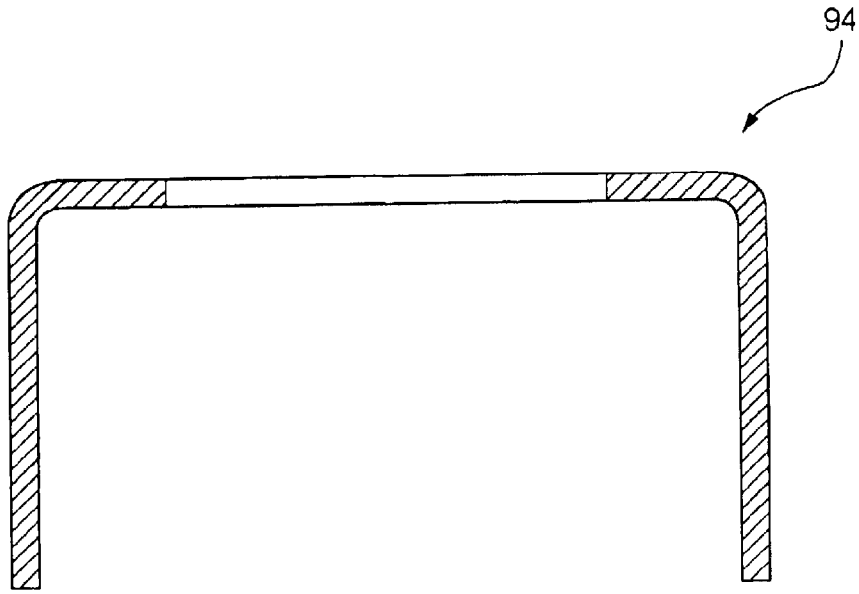
FIG. 5 is a cross-sectional view of a flange washer in the present invention.

FIG. 4 is a plan view of a flange washer according to the present invention and FIG. 5 is a cross-sectional view of a flange washer according to the present invention.

Referring to FIG. 4 and FIG. 5, the shape of the flange washer 94 adopted to the present invention would be clearly understood. More specifically, the flange washer 94 is of a cylindrical shape on the whole and an opened portion in the upper side is reduced.

With such shape of the flange washer 94, when the spindle 50 is moved to the lower side, the mounting member 81 and the bearing supporters 52 and 54 could be inserted to the inside of the flange washer 94, whereby the up and down movement stroke of the spindle 50 could increase finally.

Figure 6:
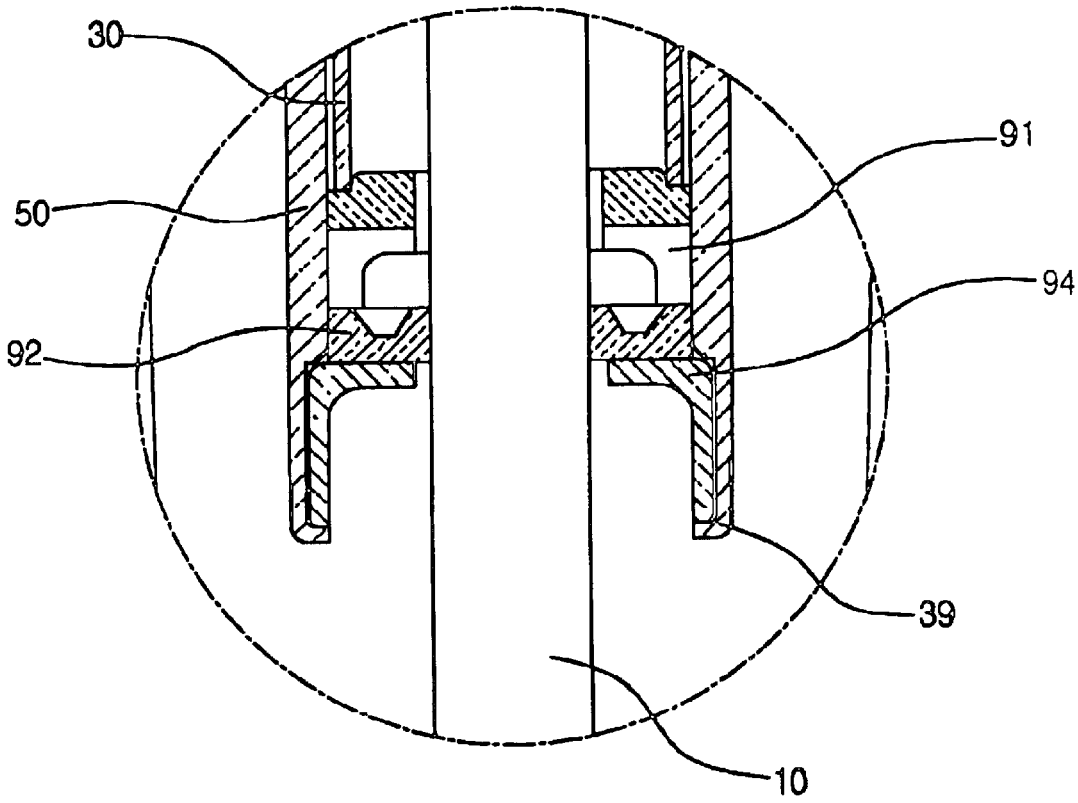
FIG. 6 is a drawing showing a sealing means according to another embodiment of the present invention.

A sealing means according to another embodiment of the present invention, is possibly realized with the flange 93 that is fit between the gas seal 92 and the flange washer 94 removed, and more specifically, even the sealing means as shown in FIG. 6 has no influence on realization of the object of the present invention.

In the meantime, as already described, with structure that the mounting member 81 could be inserted to the inside of the flange washer 94, the up and down movement stroke of the spindle 50 could increase, and further the longer piston rod 10 could be used. But, in case that the spindle 50 of the same size is moved even further to the lower side, there exists possibility that the piston 11 formed on the upper end of the piston rod 10 comes into contact with the gas opening/closing pin 20 due to the length of the longer piston rod. Furthermore, in that case, the size of the first chamber 301 undesirably becomes too narrow.

Construction of the gas cylinder of the present invention to resolve such problem, will be described in the following.

Figure 7:
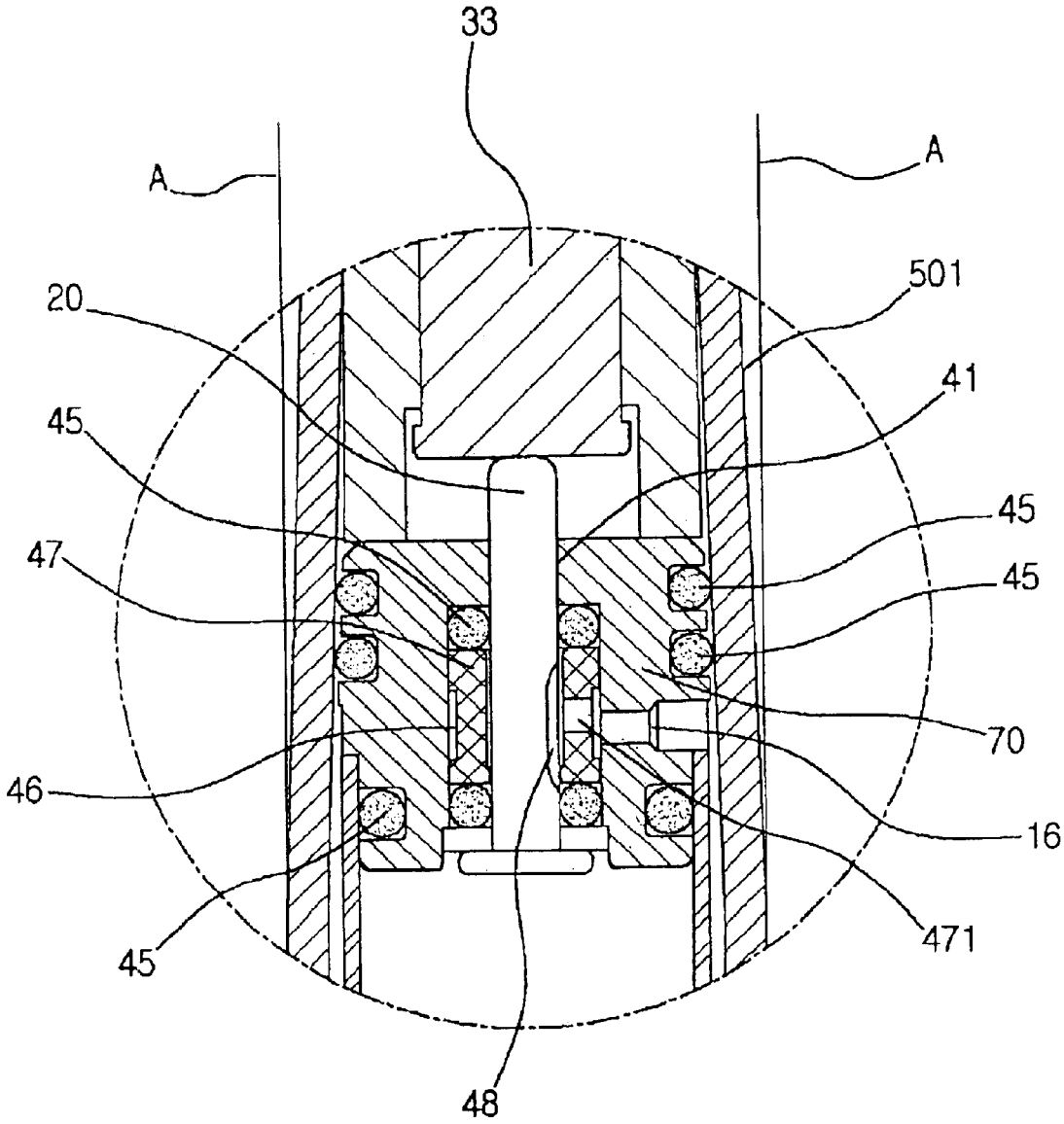
FIG. 7 is an enlarged view of an upper part of a spindle according to the present invention.

FIG. 7 is an enlarged view of the upper part of the spindle according to the present invention.

Referring to FIG. 7, the pipe holder 70 as already described is of a circular cylinder shape on the whole, and has an operating hole 41 for receiving a gas opening/closing pin 20 in its center, and has a plurality of O-rings 45 fixed in an O-ring groove on its outer side, for maintaining sealing between the pipe holder 70 and the inner wall of the spindle 50. Also, a space part 46 for gas flowing is formed in the center of the inside of the pipe holder 70, and the space part 46 also has O-rings 45 installed on its both ends, respectively, for maintaining sealing between the gas opening/closing pin 20 and the inner surface of the pipe holder 7.0. Also, the space part 46 has an inner holder 47 for maintenance of interval between the O-rings 45 and smooth sliding movement of the gas opening/closing pin 20. A fine hole 471 for being connected to and leading to the gas entrance port 16, is provided on one side of the inner holder. Also, a concave groove 48 formed by collapse of part of the gas opening/closing pin 20, is formed on the lateral side of the gas opening/closing pin 20.

In the status that the gas opening/closing pin 20 is moved to the lower side, the first and the second chamber 301 and 302 are connected each other through the concave groove 48, the fine hole 471 and the gas entrance port 16.

Particularly, the lower end of the pipe holder 70 is positioned higher than the position where the taper part 501 begins at the upper side of the spindle 50. Such position of the pipe holder 70 is for giving a room for up and down movements of the piston 11. More specifically, even in case that the spindle 50 is moved to the lower extreme, a predetermined extra space is formed so that the upper end of the piston 11 may not come into contact with the lower end of the pipe holder 70. Further, the extra space functions as a predetermined interval in which the gas opening/closing pin 20 is moved up and down.

Also, complete sealing between the outer periphery of the pipe holder 70 and the inner periphery of the spindle could be maintained by the O-rings 45, and the angle by which the taper part 501 is tapered is negligibly small, so that there is no problem in sealing of the chambers 301 and 302. The auxiliary line A is a line for showing the tapered angle of the taper part 501, and the angel of the taper part 501 could be clearly understood by this auxiliary line.

Figure 8:
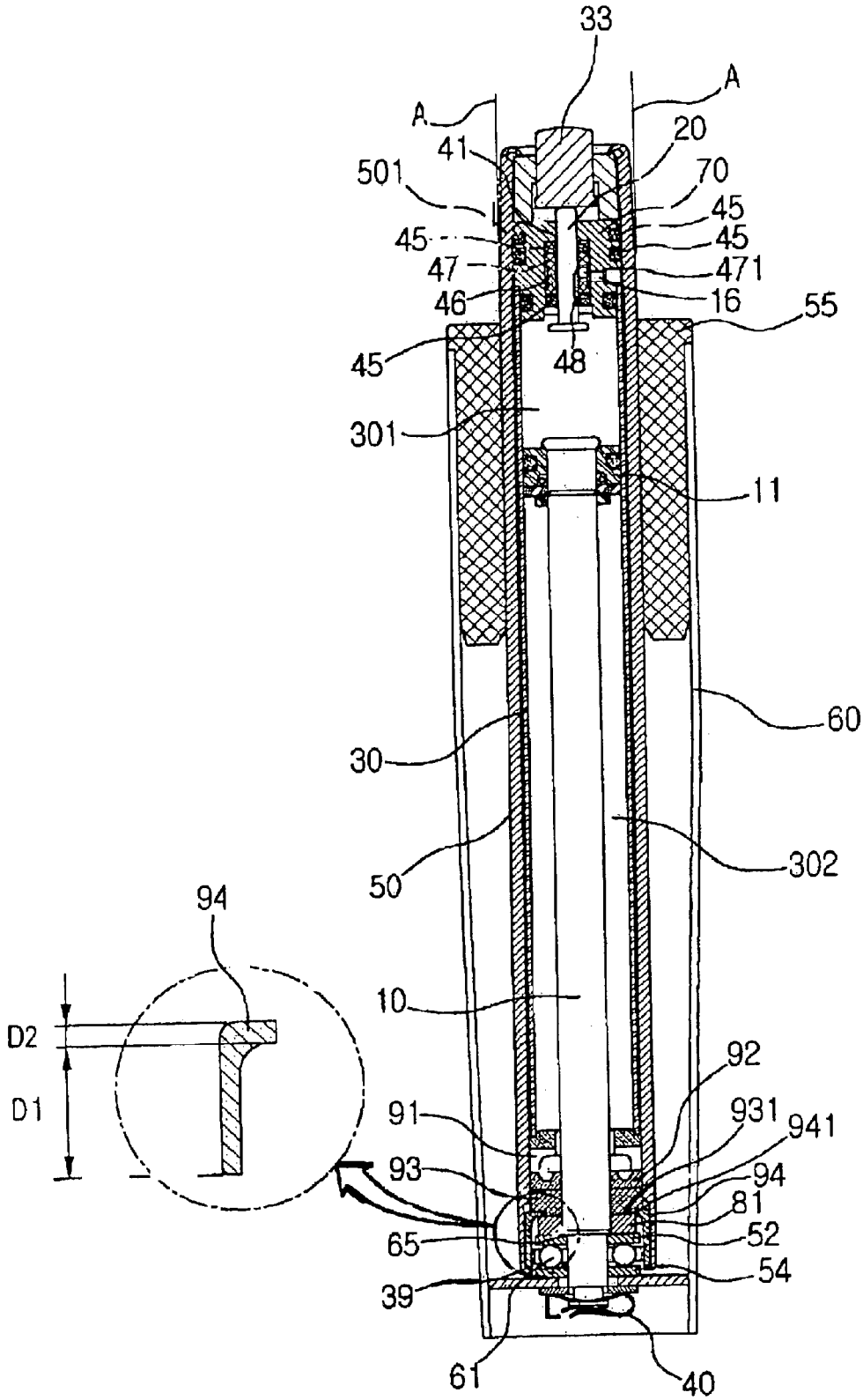
FIG. 8 is a drawing showing a case that a spindle is moved to the lower extreme in a gas cylinder according to the present invention.
Figure 9:
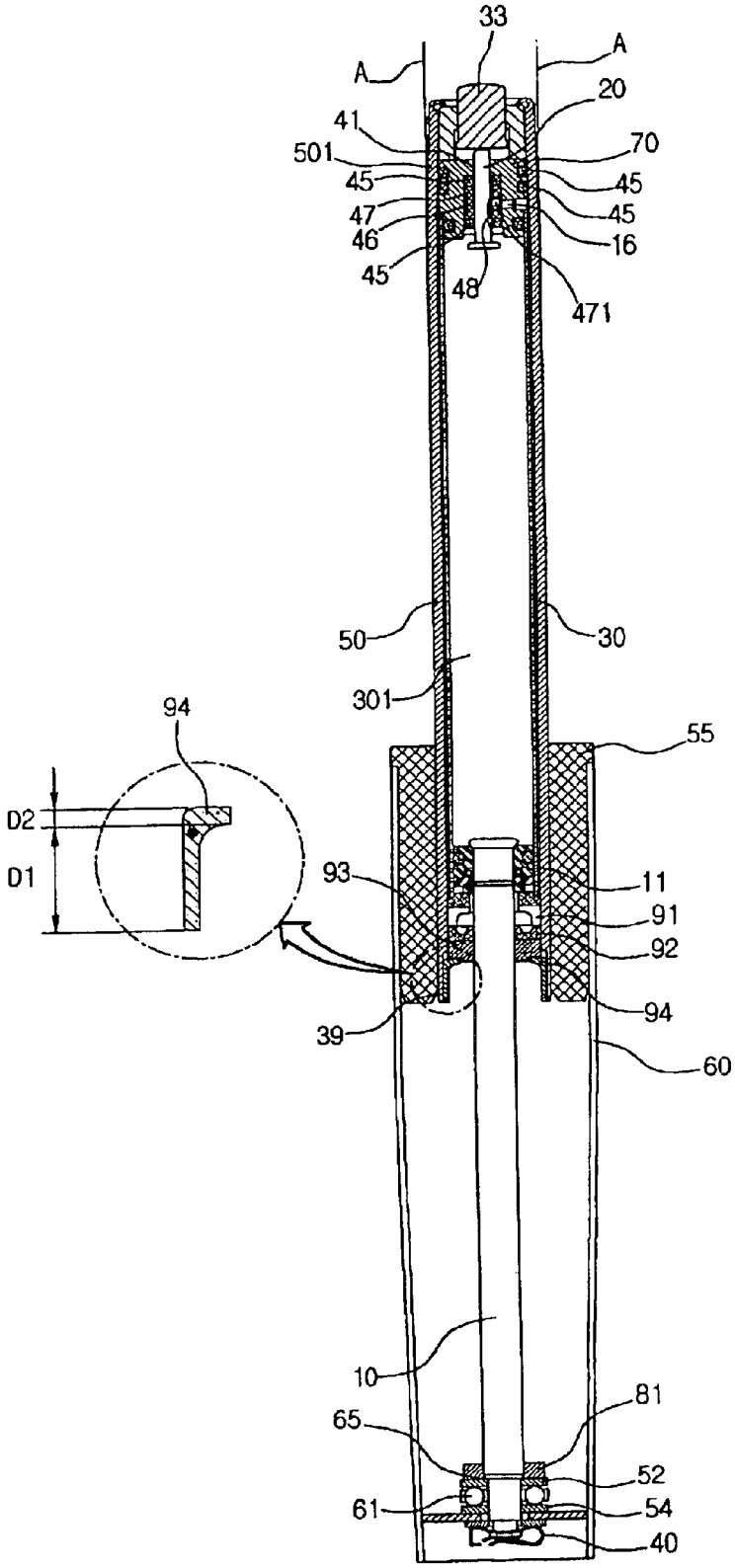
FIG. 9 is a drawing showing a case that a spindle is moved to the upper extreme in a gas cylinder according to the present invention.

FIG. 8 and FIG. 9 are drawings explaining operation and effect of the present invention. More specifically, FIG. 8 explains the case that the spindle is moved to the lower extreme in the gas cylinder according to the present invention, and FIG. 9 explains the case that the spindle is moved to the upper extreme in the gas cylinder according to the present invention.

Referring to FIG. 8 and FIG. 9, movement stroke of the gas cylinder to the up and down directions according to the present invention, will be described. The position that the spindle 50 is moved to the upper extreme, is when volume of the second chamber 302 is reduced to its minimum so that the first chamber 301 is increased to its maximum.

Also, if the spindle 50 is moved to the lower extreme, the upper side of the mounting member 81 comes into contact with the lower side 931 of the flange 93 and part of the lower side 941 of the flange washer 94.

Particularly, the flange washer 94 includes the region D1 having an inner diameter such that the mounting member 81 and the bearing supporters 52 and 54 could pass through, and the region D2 at which the mounting member 81 is hooked and whose size is reduced compared with the region D1.

With such flange washer having the foregoing construction, in case that the spindle is moved to the lower extreme as shown in FIG. 3, the lower end of the spindle 50 could be moved further to the lower extreme without being touched with the mounting member 81 and the bearing supporters 52 and 54. Also, with the construction that the spindle could be moved further to the lower side, in case that the spindle is moved to the upper extreme in the up direction, contacting area between the tube guide 55 and the spindle 50 gets increased as much as the length of the extended outer skin 39 of the spindle, namely, as much as the region D1.

Therefore, a bending defect of the spindle generated due to reduction of contacting area between the tube guide and the spindle when the spindle is extended to its maximum, is prevented, whereby the movement stroke of the spindle is increased to the maximum.

In the meantime, also the pipe holder 70 is formed in the inside of the taper part 501, so that the volume of the first chamber 301 could be maintained constant. More specifically, even though the spindle 50 is moved to the lower side as much as the region D1 of the flange washer 94, the pipe holder 70 is moved further to the upper side of the spindle 50, so that the volume of the first chamber 301 is maintained constant.

As described above, in order to maintain the constant volume of the first chamber 301, the pipe holder 70 is preferably inserted to the inside of the taper part 501 as much as the height of the region D1.

With the foregoing construction that the outer skin 39 of the spindle is extended to the lower side of the mounting member, a bending defect of the spindle generated due to reduction of contacting area between the tube guide 55 and the spindle 50 when the spindle is extended to its maximum, is prevented.

Also, the movement stroke of the spindle could be maximized while a bending defect is prevented.

Resultantly, according to the present invention, even in case that large stroke is required in the gas cylinder like the case that a body of a user is big, the gas cylinder could be appropriately used with simple structure change according to the present invention, without requiring new design for the gas cylinder.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A gas cylinder for use in a chair, comprising:

a pipe holder having a gas opening/closing pin for intermittently controlling gas flow;

a spindle having the pipe holder on its upper inside, said spindle having a predetermined sealing means on its lower side, said spindle further having a flange washer formed on a lower end of the sealing means, and said flange washer consisting of a first region and a second region, wherein the first region has an inner diameter larger than that of the second region, and wherein the first region has a height higher than that of the second region, said spindle including an upper end adapted for affixing to a seat of a chair;

a piston inserted into an inside of an opened cylinder of the spindle;

a piston rod having one end fixed in the piston; and a base tube of a cylindrical shape having a mounting member on which a lower end of the spindle is mounted with the mounting member inserted to an inside of the first region of the flange washer, and for fixing the other end of the piston rod in its lower side, and whose inner periphery guides an outer periphery of the spindle, the base tube having a lower side adapted for affixing in a base of a chair.

2. The gas cylinder according to claim 1, wherein a position of the flange washer is fixed by a bending part of an end in an outer skin of the spindle.

3. The gas cylinder according to claim 1, wherein a position of the flange washer is fixed by curling of an outer skin of the spindle after the flange washer is fit.

4. The gas cylinder according to claim 1, further comprising a bearing formed on a lower side of the mounting member, and part of which is inserted to an inside of the first region of the flange washer.

5. The gas cylinder according to claim 1, further comprising:

a taper part formed on an upper side of the spindle, for being forcibly fit in a seat of a chair; and another taper part formed on a lower side of the base tube, for being forcibly fit in a base of a chair.

6. The gas cylinder according to clam 1, wherein a gas seal and/or a flange inserted to the piston, for performing sealing function is provided to an upper side of the flange washer.

7. The gas cylinder according to claim 1, wherein a flange inserted to the piston, for performing sealing function, and part of which is contact with the mounting member, is provided to an upper side of the flange washer.

8. The gas cylinder according to claim 1, wherein a taper part for fitting an upper end of the spindle into approximately a center in a lower side of a seat, is provided and at least part of the pipe holder is inserted to an inside of the taper part.

9. The gas cylinder according to claim 1, wherein an upper end of the spindle is tapered and at least part of the pipe holder is inserted to the tapered part.

10. The gas cylinder according to claim 1, wherein the upper end of the spindle is bent inward, forming a taper part and the pipe holder is more deeply inserted to an inside of the taper part than the height of the first region.

11. The gas cylinder according to claim 1, wherein the mounting member is made of elastic material in order to alleviate impulse of the spindle.

12. A gas cylinder for use in a chair, comprising:

a pipe holder having a gas opening/closing pin for intermittently controlling gas flow;

a spindle having a tapered upper side and an inner tapered portion, at least part of the pipe holder being inserted in the inner tapered portion, said spindle having a predetermined sealing means on its lower side, said spindle at least having a flange washer formed on a lower end of the sealing means, said flange washer consisting of a first region and a second region, wherein the first region has an inner diameter larger than that of the second region, and wherein the first region has a height higher than that of the second region;

a piston inserted into an inside of an opened cylinder of the spindle;

a piston rod having one end fixed in the piston; and a base tube and a guiding tube of a cylindrical shape, said base tube having a mounting member on which a lower end of the spindle is mounted with the mounting member inserted to an inside of the first region of the flange washer, and for fixing the other end of the piston rod in its lower side, the guiding tube guides operation of the spindle, the base tube having a lower side adapted for affixing in a base of a chair.

13. The gas cylinder according to claim 12, wherein a position of the flange washer is fixed by a bending part of an end in an outer skin of the spindle.

14. The gas cylinder according to claim 12, wherein a position of the flange washer is fixed by curling of an outer skin of the spindle after the flange washer is fit.

15. The gas cylinder according to claim 12, further comprising a bearing formed on a lower side of the mounting member, and part of which is inserted to an inside of the first region of the flange washer.

16. The gas cylinder according to claim 12, further comprising:

a taper part formed on an upper side of the spindle, for being forcibly fit in a seat of a chair; and another taper part formed on a lower side of the base tube, for being forcibly fit in a base of a chair.

17. The gas cylinder according to claim 12, further comprising an O-ring for sealing between an outer periphery of the pipe holder and an inner periphery of the spindle.

18. A gas cylinder comprising:

a pipe holder having a gas opening/closing means;

a spindle whose upper and lower sides are closed by the pipe holder formed on an upper side and a sealing means formed on a lower side, and said sealing means at least having a flange washer consisting of two regions, each having different inner diameters are and different heights;

a piston inserted into an inside of an opened cylinder of the spindle;

a piston rod having one end is fixed in the piston; and a base tube of a cylindrical shape having a mounting member on which a lower end of the spindle is mounted with the mounting member inserted to an inside of one of said two regions of the flange washer.

* * * * *